US005503929A

United States Patent [19]

McCullough, Jr. et al.

[11] Patent Number: 5,503,929

[45] Date of Patent: Apr. 2, 1996

[54] LINEAR CARBONACEOUS FIBER WITH IMPROVED ELONGABILITY

[76] Inventors: Francis P. McCullough, Jr., 104 Fir Dr., Lake Jackson, Tex. 77566; R. Vernon Snelgrove, Rte. 1, Box 112, Damon, Tex. 77430; Bhuvenesh C. Goswami, 2000 Strawberry La., Clemson, S.C. 29631

[21] Appl. No.: 238,005

[22] Filed: May 3, 1994

Related U.S. Application Data

[60] Division of Ser. No. 876,275, Apr. 30, 1992, Pat. No. 5,328,764, which is a continuation-in-part of Ser. No. 430, 762, Nov. 1, 1989, abandoned.

[51] Int. Cl.[6] ..... P02G 3/00

[52] U.S. Cl. ..... 428/364; 428/357; 428/359; 428/375; 428/408; 521/149

[58] Field of Search ..... 428/369, 357, 428/362, 364, 367, 361, 373, 203, 408, 364, 375, 382; 521/149

[56] References Cited

U.S. PATENT DOCUMENTS

| | | | |
|---|---|---|---|
| 4,857,394 | 9/1989 | McCullough, Jr. et al. | 428/303 |
| 4,937,140 | 6/1990 | McCullough, Jr. et al. | 428/375 |
| 4,950,540 | 9/1990 | McCullough, Jr. et al. | 428/369 |
| 4,999,385 | 3/1991 | McCullough, Jr. et al. | 521/149 |
| 5,328,764 | 7/1994 | McCullough, Jr. et al. | 428/364 |

*Primary Examiner*—Patrick J. Ryan
*Assistant Examiner*—Merrick Dixon

[57] ABSTRACT

A process for preparing a non-flammable linear non-graphitic carbonaceous polymeric fiber, yarn or tow having improved elongability containing the step of heat treating a linear stabilized polymeric fiber, yarn or tow having an LOI greater than 40 without any substantial tension or stress in an inert non-oxidizing atmosphere at a temperature so as to irreversibly heat set said fiber yarn or tow.

4 Claims, 1 Drawing Sheet

LINEAR CARBONACEOUS FIBER WITH IMPROVED ELONGABILITY

RELATED APPLICATIONS

This is a divisional application of Ser. No. 07/876,275, filed Apr. 30, 1992, now U.S. Pat. No. 5,328,764 which is a continuation-in-part of application Ser. No. 430,762 filed Nov. 1, 1989, now abandoned, entitled "Linear Carbonaceous Fiber with Improved Elongability" of Mc Cullough et al.

FIELD OF THE INVENTION

The present invention relates to a process for preparing non-graphitic linear carbonaceous fibers having improved processability and elongability and to the textile structures prepared thereby. The process is especially suited for preparing superfine carbonaceous fibers having a single fiber diameter of about 4 to 12 microns or smaller.

BACKGROUND OF THE INVENTION

In the processing of fibers into textile structures, the fibers undergo a variety of stresses and strains which cause fiber breakage. Fibers with improved elongability are capable of better withstanding these stresses and strains. Moreover, fabrics which contain fibers having good elongability have the advantage of being stretchable and wrinkle resistant.

When carbon and graphitic fibers are produced from a stabilized acrylic precursor fiber, the extensibility or percent extension is typically in the range of elongation is about 1 25 to 1.9%, depending upon the heat treatment, the degree of carbonization or graphitization and modulus of the fiber. Typical linear graphitic or carbon fibers are produced by processing tows of from 1,000 to 320,000 filaments through a zone temperature furnace which heat treats the fiber in a temperature range of from about 300° C. graduated rapidly up to about a 1050° to 1100° C. temperature range. This treatment is generally followed by a subsequent heat treatment in a high temperature furnace where the fiber is taken up at a temperature of from about 1400° to 2400° C. The heat treatment is carried out under tension even in a low temperature furnace. That is, the fibers are suspended through the furnace with sufficient tension to pull the fiber tows through the furnace and to keep them off the floor or bottom of the furnace.

It is especially advantageous if one desires to perform textile processing to have a percent elongation of from about 3 to 9% or greater. When a partially carbonized fiber, that is, a fiber which still have a nitrogen content of from 10 to 20%, is heat treated at from 550° to 650° C. under tension, the extensibility of the fiber is only 2.5% or less. This low extensibility is insufficient for textile processing without encountering considerable fiber breakage.

U.S. Pat. No. 4,347,297 to Mishima et al discloses a process for the preparation of carbon fibers by two preoxidation treatments of polyacrylonitrile fibers under tension and the carbonizing of the oxidized fibers under tension.

U.S. Pat. No. 4,279,612 to Saji et al discloses a method for producing carbon fibers which includes the step of thermally stabilizing the fibers under tension before heat treatment to carbonize the fibers.

U.S. Pat. No. 3,541,582 to Fainborough et al which discloses the preparation of woven carbon cloth by first oxidizing continuous yarns of polymeric fibers while under tension. The carbonization step is performed either while under tension or without tension. However, the woven cloth inherently places the fibers under tension.

U.S. Pat. No. 4,837,076 to Mc Cullough et al, which is herein incorporated by reference, discloses a process for preparing non-linear carbonaceous fibers, yarns and tows having a reversible deflection greater than 1.2:1. The conditions for heat treatment described in the patent can be used to provide similar electrical conductivity to the linear fibers of the invention. However, there is not disclosed any improvement in elongability other than as a result of the non-linear configuration. The non-linear carbonaceous fibers have a pseudoelongability as well as elongability after fiber tension. The non-linear fibers are prepared by heat treating a woven or knitted fabric and then deknitting. The use of a woven or knitted fabric adds costs to the process, and additionally provides a sufficient degree of stress to create cracks and voids.

U.S. Pat. No. 4,937,140, to Mc Cullough et al, which is herein incorporated by reference, discloses a process of fluorinating carbonaceous fibers which may be utilized in the present invention to provide fluorinated linear fibers having improved elongability.

U.S. Pat. No. 5,051,216 to Nakatani et al discloses a carbon fiber having an improved modulus of elasticity. The carbon fiber is prepared by applying tension to the fiber while heating. However, it has been found that applying heat to carbonaceous fibers under tension results in cracks and voids which weakens the fibers.

The term "carbonaceous fibers, tows and yarns" is understood to mean fibers, yarns and tows which have been heated to have an increased carbon content, namely, a carbon content of greater than 65% or an increase in carbon content as a result of an irreversible chemical reaction.

The term "graphitic" as used herein relates to those carbonaceous materials having an elemental carbon content of at least about 92%, preferably, about 98%, and as further defined in U.S. Pat. No. 4,005,183 to Singer, which is herewith incorporated by reference.

The term "pseudoelongability" as used herein relates to the percent elongation of a non-linear (crimped) fiber to remove the crimp so as to form a linear fiber without any internal molecular rearrangement of the fiber.

It is to be understood that the percentage stated relate to percent by weight of the total composition unless stated otherwise.

SUMMARY OF THE INVENTION

In accordance with the invention there is provided a non-flammable linear non-graphitic carbonaceous polymeric fiber or tow having improved processability and elongability. The fiber or tow is prepared by the step of heat treating a linear stabilized polymeric fiber or tow having an LOI greater than 40 without any substantial tension or stress in an inert atmosphere at a temperature so as to irreversibly heat set said fiber or tow. Advantageously, the fiber or tow is heat treated at about zero tension. The invention provides a carbonaceous fiber having a fiber diameter of about 4 to 12 microns, an elongability of about 2.5 to 9% and a pseudolongability of about zero.

It has been found that the improved elongability is retained even after the carbonaceous fiber, yarn or tow has been fluorinated. Advantageously, the fibers of the invention have a strand tenacity of about 2 to 9 g/d.

DESCRIPTION OF THE PREFERRED EMBODIMENTS

In accordance with the present invention a linear stabilized polymeric fiber or tow is processed into a linear non-graphitic carbonaceous linear fibers or tows. The non-graphitic carbonaceous fibers of the invention are provided with an improved percent extensibility or elongability and processability. It has been found that contrary to the prior art methods of preparing carbon fibers by placing the fiber under tension during heat treatment to prevent shrinkage, no tension or stress during heat treatment of the precursor material results in improved elongability for the resulting non-graphitic carbonaceous fiber.

Figure 1:
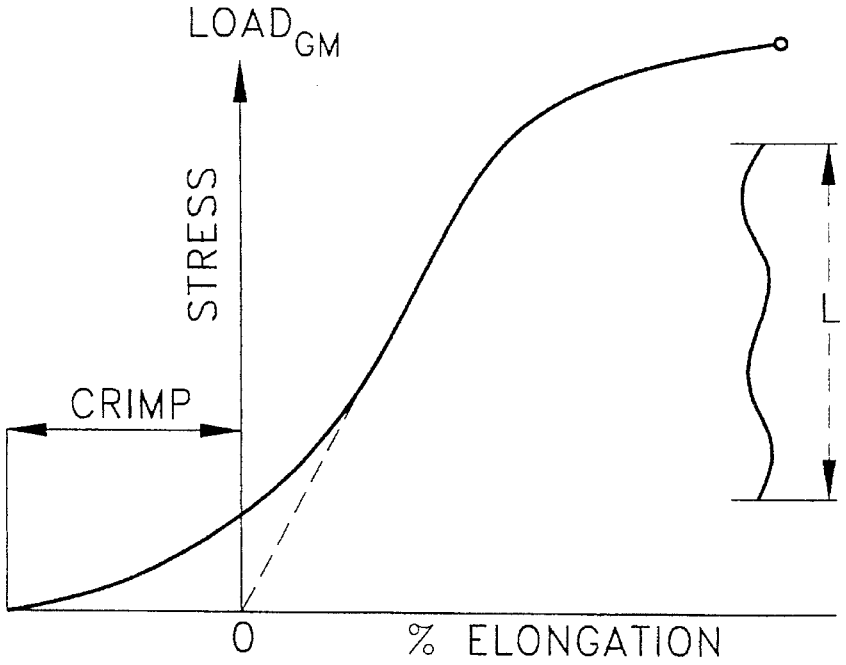
FIG. 1 is a graph illustrating the elongation of a carbonaceous non-linear fiber.
Figure 2:
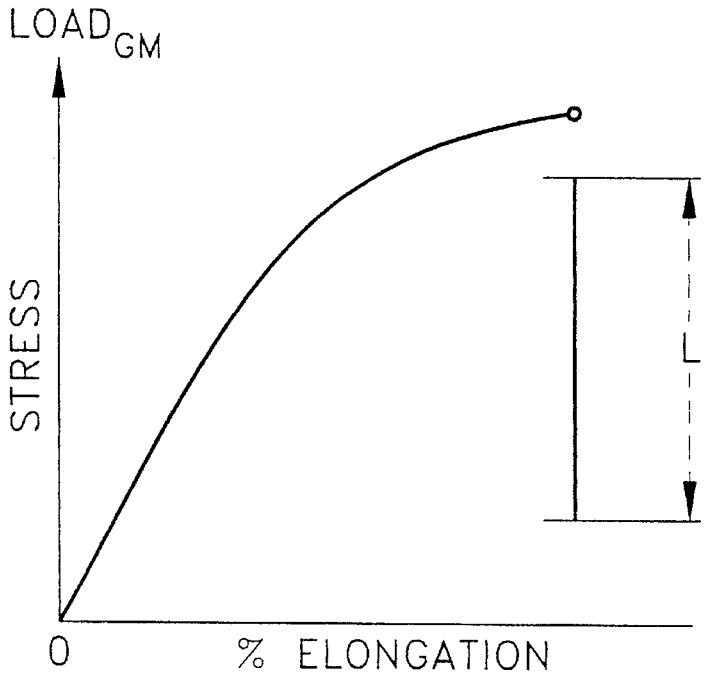
FIG. 2 is a graph illustrating the elongation of a carbonaceous linear fiber.

As illustrated in the drawing, there is a difference in the elongation of a non-linear carbonaceous fiber and the linear carbonaceous fiber of the invention. FIG. 1 shows a typical elongation which occurs with a non-linear carbonaceous fiber. That is, there is both a pseudoelongation and a normal elongation. The fiber undergoes a pseudoelongation as seen in the "crimp" portion of the graph when the fiber is first made taunt. That is, when the non-linear fiber is straightened, there is a percent elongation as a result of the crimp without any internal molecular rearrangement of the fiber. The continued elongation of the crimped fiber with stress provides an elongation which is similar to the elongation found in a linear fiber as seen in FIG. 2. Thus, in processing, the non-linear fiber experiences an irregularity in the modulus of elasticity because of the pseudoelongation and the "normal" elongation.

Linear carbonaceous fibers preferably should be able to undergo elongation to some degree without fiber breakage during processing. Moreover, in the processing of the carbonaceous fibers in the manufacture of densified structures, there should be as little irregularities as possible in the modulus of elasticity to prevent voids.

Typically as seen in FIG. 1, for an 8 to 10 micron non-linear fiber, a 0.1 mg weight elongates the fiber about 125% as a result of removing the crimp. A 2 gm weight further elongates the fiber only about 5% and a 5 gm weight elongates the fiber to break at a point where there is less than about 1% deflection remaining.

As seen in FIG. 2, the already linear fiber has no pseudoelongation and elongates a small percentage of the amount of the non-linear fiber. Consequently, the two fibers' performance and processability are different. The linear fibers are particularly useful where densified structures may be required, for example, in insulation.

The non-graphitic linear carbonaceous fibers which are produced by the invention have the characteristics of improved elongability, non-flammability, and ignition resistance.

The linear carbonaceous fibers of this invention have an LOI value greater than 40 when the fibers are tested according to the test method of ASTM D 2863-77. The test method is also known as the "oxygen index" or "limited oxygen index" (LOI). With this procedure the concentration of oxygen in $0_2/N_2$ mixtures is determined at which a vertically mounted specimen is ignited at its upper end and just barely continues to burn. The width of the specimen is 0.65 to 0.3 cm with a length of from 7 to 15 cm. The LOI value is calculated according to the equation:

$$LOI = \frac{[O_2]}{[O_2] + [N_2]}$$

Briefly, the carbonaceous fibers of this invention are prepared by heat treating in an inert atmosphere a suitable stabilized or oxidized precursor polymeric fiber which can be made into an irreversibly heat set, fiber or filament without tension or stress. preferably, the stabilized precursor material used in the present invention is derived from oxidatively stabilized polyacrylonitrile (PAN) filaments.

Polymeric precursor materials such as stabilized acrylic filaments which are advantageously utilized in preparing the carbonaceous fibers of the invention are selected from one or more of the following: acrylonitrile based homopolymers, acrylonitrile based copolymers and acrylonitrile based terpolymers. The copolymers preferably contain at least about 85 mole percent of acrylonitrile units and up to 15 mole percent of one or more monovinyl units.

Examples of other vinyl monomers copolymerizable with acrylonitrile include methacrylic acid esters and acrylic acid esters such as methyl methacrylate, ethyl methacrylate, propyl methacrylate, butyl methacrylate, methyl acrylate and ethyl acrylate; vinyl esters such as vinyl acetate and vinyl propionate; acrylic acid, methacrylic acid, maleic acid, itaconic acid and the salts thereof; vinylsulfonic acid and the salts thereof.

The preferred precursor materials are typically prepared by melt spinning, dry or wet spinning the precursor materials in a known manner to yield a monofilament or multifiber tow. The fibers or tow are then heated to a temperature and for a period of time as described in U.S. Pat. No. 4,837,076.

The polyacrylonitrile (PAN) based fibers may be formed by conventional methods such as by melt, dry or wet spinning a suitable liquid of the precursor material. The polyacrylonitrile (PAN) based fibers which have a normal nominal diameter of from 4 to 25 micrometers are collected as an assembly of a multiplicity of continuous filaments in tows. The fibers are then stabilized, for example by oxidation or any other conventional method of stabilization. These stabilized fibers typically have an elongability of about 1.25 to 1.9% The stabilized fibers, tows or staple yarn which are typically made from chopped or stretch broken fiber staple are thereafter heat treated according to the present invention, in a relaxed and unstressed condition, at elevated temperatures in an inert non-oxidizing atmosphere for a period of time to produce a heat induced thermoset reaction while maintaining a nitrogen content of between about 5 to 35%. At a temperature range of from 150° C. to 525° C., the fibers are generally provided with a varying proportion of temporary to permanent set while in an upper range of temperatures of from 525° C. and above, the fibers are provided with a substantially permanent or irreversible heat set.

It is to be understood that the fiber or tow may be initially heat treated at the higher range of temperatures so long as the heat treatment is conducted while the fiber is in a relaxed or unstressed state and under an inert, non-oxidizing atmosphere including under a reduced pressure atmosphere. Preferably, the stabilized precursor is prepared without stress or strain.

As a result of the higher temperature treatment of 525° C. and above, a substantially permanently or irreversible heat set is imparted to the fibers, yarns or tows. The resulting tows or fibers may be used per se or formed into a wool-like fluff or batting that is useful for providing insulation.

Other stabilized linear polymeric fibers can also be prepared from well known materials such as pitch (petroleum or coal tar), polyacetylene, polyphenylene, polyvinylidene chloride polyaromatic amides (KEVLAR®, a trademark of E. I. du Pont de Nemours & Co.), polybenzimide resin, SARAN® (trademark of The Dow Chemical Company), and the like.

The improved carbonaceous acrylonitrile based fibers which are prepared according to this invention may be classified into three groups.

In a first group, the carbonaceous fibers are electrically nonconductive and possess no antistatic characteristics, i.e., they are not able to dissipate an electrostatic charge.

The term electrically nonconductive as utilized in the present invention relates to a resistance of greater than $4\times10^6$ ohms/cm when measured on a 6K (6000 filaments) tow or fibers having a single fiber diameter of from 4 to 20 microns and a nitrogen content greater than about 18%. The preferred fibers of this group have an elongation of about 3 to 9 percent.

When the fiber is a stabilized and heat set acrylic fiber it has been found that a nitrogen content of about 18% or higher results in an electrically nonconductive fiber.

In a second group, the carbonaceous fibers are classified as being partially electrically conductive (i.e., having a low conductivity), have static dissipating characteristics, have a carbon content of greater than 65% and a nitrogen content of about 14 to 18%. Low conductivity means that a 6K tow of fibers in which the precursor fiber have a single fiber diameter of from 4 to 20 microns, have a tow resistance of from about $4\times10^6$ to $4\times10^3$ ohms/cm. The preferred fibers of this group have an elongation of about 3 to 6 percent.

In a third group are the fibers having a carbon content of at least 85% and a nitrogen content of at least 5%. These fibers are characterized as having a high electroconductivity and a specific resistivity of less than $10^{-1}$ ohm-cm.

The preferred fibers of the third group have an elongation of about 2.5 to 4 percent.

The non-graphitic carbonaceous fibers of the three groups may be fluorinated as disclosed in aforementioned U.S. Pat. No. 4,857,394 so as to provide flexible fibers of different electrical conductivity having a non-electrically conductive surface.

Generally, the textile structures formed from the fibers of the invention are lightweight, have low moisture absorbency, good strength and elongability together with good appearance and handle.

The fibers of this invention may be used in substantially any desired fabricated form. The carbonaceous fibers can be readily stretch broken and formed by conventional equipment into spun yarn and then into cloth, such as herringbone weave cloth, twill weave tape, tubular woven fabric, paper, batts, blankets, roving, yarn, cord, rope and nonwoven structures.

The carbonaceous fibers may be used alone or blended with other synthetic or natural fibers. Examples of other fibers that may be used include linear and non-linear fibers that may be selected from natural or polymeric fibers, other carbon fibers, ceramic fibers, glass fibers, or metal or metal coated fibers. Particular natural and/or synthetic polymeric fibers that may be included into a blend with the carbonaceous fibers are cotton, wool, polyester, polyolefin, nylon, rayon, fibers of silica, silica alumina, potassium titanate, silicon carbide, silicon nitride, boron nitride, boron, acrylic fibers, tetrafluoroethylene fibers, polyamide fibers, vinyl fibers, protein fibers, and oxide fibers derived from boron, thoria or zirconia.

Exemplary of the present invention are the following examples:

EXAMPLE 1

An oxidized acrylonitrile based precursor fiber, sold under the name PANOX by R.K. Carbon Fibers, Inc., Philadelphia, Pa., having a density of 1.36–1.39 g/cc and at least 85 mole percent of acrylonitrile units, is heat treated in a low temperature furnace at a peak temperature of from 525° to 650° C. in a purged nitrogen environment according to the proceedings described in U.S. Pat. No. 4,857,394 so as to produce a partially carbonized fiber having an elongation of between 4 to 6%. In lieu of a purged nitrogen atmosphere, the system may be purged with nitrogen and then evacuated.

EXAMPLE 2

Following the general procedure as outlined in Example 1 as to source of precursor fiber and furnace, the precursor fiber is chopped into from 1.5 to 3 inch staple. The fiber is placed on a fine mesh belt and pulled through the furnace without tension on the fiber to produce staple partially carbonized fiber having an elongation of from 4 to 7%.

EXAMPLE 3

Samples of Example 1 and 2 are blended with 60% KODEL 435 polyester staple fiber similar to that disclosed in U.S. patent application Ser. No. 114,324 and 20% Kodel 410 binder fiber with 20% of the improved linear partially carbonized fiber on a randomizing card. The blended fiber is then placed in a Rando B non-woven web former and a 4oz. per square yard non-woven batting is produced. This resulting batting has fire resistant characteristics and passes the vertical burn test according to FTM-5903 and FAR25.853b.

EXAMPLE 4

Following the procedure disclosed in U.S. Pat. No. 4,857,404, the carbonaceous fibers of Example 1 are placed in a monel reaction vessel. The reaction vessel is evacuated and fluorine gas diluted with helium gas is flowed into the reactor. The amount of fluorine reacted is about 0.1 to 2.5 moles per mole of carbon and typically about 1 mole of fluorine per mole of carbon. The percent fluorine reacted is about 1 to 75%. The reaction time is about 5 minutes to one hour. The fibers maintain the same elongability as the non-fluorinated fibers.

EXAMPLE 5

Following the procedure of Example 1, a non-graphitic carbonaceous fiber having a 0.3 to 0.6 denier is prepared utilizing an acrylonitrile based fiber having a tensile strength of about 6 g/d. The fiber comprised 96% by weight acrylonitrile and 4% by weight methylacrylate.

The fiber was subjected to a preoxidation treatment at 270° C. for 25 minutes without stress.

The oxidized fiber was then heat treated at 525° C. in a purged nitrogen atmosphere environment to produce a partially carbonized fiber having an elongation of 6% and a tenacity of about 5 g/d.

What is claimed is:

1. Insulation which comprises non-flammable linear non-graphitic carbonaceous polymeric fibers having improved elongability and processability, said fibers comprising a non-graphitic heat treated irreversibly set linear stabilized polyacrylonitrile based fibers having an LOI greater than 40, an elongability of about 2.5 to 9% and a pseudoelongability of about zero.

2. The insulation of claim 1 wherein said stabilized polyacrylonitrile based fibers are selected from the group consisting of acrylonitrile homopolyers, acrylonitrile copolymers and acrylonitrile terpolymers.

3. The insulation of claim 1, wherein said fibers have a carbon content less than 85 percent, a nitrogen content of more than 18%, and wherein said fibers are electrically nonconductive, do not possess any electrostatic dissipating characteristics, and have an electrical resistance of greater than $4\times10^3$ ohms/cm, when measured on a 6K tow of fiber having a single fiber diameter of 4 to 20 microns.

4. The insulation of claim 1 wherein said fibers have a strand tenacity of about 2 to 9 g/d.

* * * * *